US009768006B2

(12) United States Patent
Quarmby et al.

(10) Patent No.: US 9,768,006 B2
(45) Date of Patent: Sep. 19, 2017

(54) ION TRANSFER TUBE FLOW AND PUMPING SYSTEM LOAD

(71) Applicant: Thermo Finnigan LLC, San Jose, CA (US)

(72) Inventors: Scott T. Quarmby, Round Rock, TX (US); Edward B. McCauley, Cedar Park, TX (US); Joshua T. Maze, Round Rock, TX (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/001,667

(22) Filed: Jan. 20, 2016

(65) Prior Publication Data

US 2017/0207075 A1 Jul. 20, 2017

(51) Int. Cl.
*H01J 49/24* (2006.01)
*H01J 49/16* (2006.01)

(52) U.S. Cl.
CPC ..... *H01J 49/24* (2013.01); *H01J 49/165* (2013.01); *H01J 2237/182* (2013.01)

(58) Field of Classification Search
USPC ..... 250/288, 281, 282
See application file for complete search history.

(56) References Cited

U.S. PATENT DOCUMENTS

| | | | | |
|---|---|---|---|---|
| 5,171,990 | A | 12/1992 | Mylchreest et al. | |
| 5,235,186 | A * | 8/1993 | Robins | H01J 49/165 250/281 |
| 6,777,672 | B1 | 8/2004 | Park | |
| 6,787,764 | B2 | 9/2004 | Park | |
| 7,081,620 | B2 | 7/2006 | Kato | |
| 7,109,478 | B2 | 9/2006 | Park | |
| 2003/0122069 | A1 * | 7/2003 | Kato | H01J 49/045 250/288 |
| 2008/0142698 | A1 * | 6/2008 | Atherton | H01J 49/0404 250/282 |
| 2012/0153141 | A1 * | 6/2012 | Wouters | B23H 9/14 250/282 |

* cited by examiner

*Primary Examiner* — Kiet T Nguyen
(74) *Attorney, Agent, or Firm* — David A. Schell

(57) ABSTRACT

A mass spectrometer system can include an ion source, a vacuum chamber; a mass analyzer within the vacuum chamber, a transfer tube between the ion source and the vacuum chamber, a transfer tube heater, and a vacuum pump. The mass spectrometer system can be configured to reduce the pump speed of the vacuum pump in response to receiving a transfer tube swap instruction; lower the temperature of the transfer tube to below a first threshold; operating the vacuum pump at the reduced pump speed while the transfer tube is replaced with a second transfer tube; heating the second transfer tube to a temperature above a pump down temperature; and increasing the pump speed of the vacuum pump after the temperature of the second transfer tube exceeds a second threshold.

18 Claims, 9 Drawing Sheets

ION TRANSFER TUBE FLOW AND PUMPING SYSTEM LOAD

FIELD

The present disclosure generally relates to the field of mass spectrometry including systems and methods for improving ion transfer tube flow and pumping system load.

INTRODUCTION

Mass spectrometry is an analytical chemistry technique that can identify the amount and type of chemicals present in a sample by measuring the mass-to-charge ratio and abundance of gas-phase ions. Analysis of the gas-phase ions is typically conducted under vacuum while samples may be introduced at atmospheric pressure. In liquid chromatography mass spectrometry, an eluate from a liquid chromatography system, such as a High Performance Liquid Chromatography (HPLC) system can be vaporized and ionized, such as by electrospray ionization, to produce the gas-phase ions. Typically, the vaporization and ionization is performed at atmospheric or near atmospheric pressures and can be accompanied by a significant gas flow. Alternatively, using sub ambient electrospray ionization, the vaporization and ionization can occur at below atmospheric pressures, but still significantly higher than the pressures required for mass analysis. Bringing the gas-phase ions into the mass spectrometry system vacuum chamber for mass analysis generally occurs through an ion transfer tube or orifice and introduces a significant gas flow to the system. To maintain high vacuum while accommodating the gas flow can require a significant vacuum pumping system.

From the foregoing it will be appreciated that a need exists for improvements in ion transfer tube flow and pumping system load.

SUMMARY

In a first aspect, a mass spectrometer system can include an ion source, a vacuum chamber; a mass analyzer within the vacuum chamber, a first transfer tube between the ion source and the vacuum chamber, a transfer tube heater, and a vacuum pump. The ion source can be configured to produce ions from a sample. In various embodiments, the ion source can be at substantially atmospheric pressure. Alternatively, such as for sub ambient electrospray ionization, the ion source can be at sub ambient pressures, such as on the order of about $10^1$ to about $10^2$ Torr. The mass analyzer can be configured to determine mass-to-charge ratios for ions from the sample. The transfer tube can be configured to allow passage of the ions from the ion source to the vacuum chamber. The transfer tube heater can be configured to heat the transfer tube to and maintain the transfer tube at an operating temperature. The vacuum pump can be configured to maintain the vacuum chamber at a low pressure. The mass spectrometer system can further include a computer readable storage medium having program instructions for performing steps of: controlling the transfer tube heater to maintain the first transfer tube at the operating temperature and the vacuum pump to maintain the vacuum chamber at an operating pressure; reducing the pump speed of the vacuum pump in response to receiving a transfer tube swap instruction; lowering the temperature of the first transfer tube to below a first threshold; operating the vacuum pump at the reduced pump speed while the first transfer tube is replaced with a second transfer tube to maintain the vacuum chamber at a pressure between atmospheric pressure and the operating pressure; heating a second transfer tube to a temperature above a pump down temperature; and increasing the pump speed of the vacuum pump after the temperature of the second transfer tube exceeds a second threshold to return the mass analyzer to the operating pressure.

In various embodiments of the first aspect, the operating temperature can be within a range of about 50° C. to about 550° C.

In various embodiments of the first aspect, the operating pressure can be within a range of about $10^{-11}$ Torr to about $10^{-4}$ Torr.

In various embodiments of the first aspect, reducing the pump speed can include limiting the rotational speed of the vacuum pump.

In various embodiments of the first aspect, reducing the pump speed can include limiting the power draw of the pump.

In a second aspect, a mass spectrometer system can include an ion source, a vacuum chamber, a mass analyzer within the vacuum chamber, a first transfer tube between the ion source and the vacuum chamber, a transfer tube heater, and a vacuum pump. The ion source can be configured to produce ions from a sample. In various embodiments, the ion source can be at substantially atmospheric pressure. Alternatively, such as for sub ambient electrospray ionization, the ion source can be at sub ambient pressures, such as on the order of about $10^1$ to about $10^2$ Torr. The mass analyzer can be configured to determine mass-to-charge ratios for ions from the sample. The first transfer tube can be configured to allow passage of the ions from the ion source to the vacuum chamber. The first transfer tube can be rated to operate at a temperature within a first temperature range. The transfer tube heater can be configured to heat the transfer tube. The vacuum pump can be configured to maintain the vacuum chamber at a low pressure. The mass spectrometer system can further include a computer readable storage medium having program instructions for performing steps of: controlling the transfer tube heater to maintain the transfer tube at a first temperature within the first temperature range and the vacuum pump to maintain the vacuum chamber at an operating pressure; receiving an instruction to set the transfer tube temperature to a second temperature, the second temperature within a second temperature range and outside of the first range; reducing the pump speed of the vacuum pump in response to receiving a transfer tube swap instruction; lowering the temperature of the transfer tube to below an exchange temperature; operating the vacuum pump at the reduced pump speed while the first transfer tube is replaced with a second transfer tube to maintain the vacuum chamber at a pressure between atmospheric pressure and the operating pressure, the second transfer tube rated for operating in the second temperature range; heating a second transfer tube to the second temperature; and increasing the pump speed of the vacuum pump after the temperature of the second transfer tube exceeds a threshold to return the mass analyzer to the operating pressure.

In various embodiments of the second aspect, the first temperature range can be between about 50° C. and about 550° C.

In various embodiments of the second aspect, the second temperature range can be between about 50° C. and about 550° C.

In various embodiments of the second aspect, the first temperature range and a second temperature range can be non-overlapping ranges.

In various embodiments of the second aspect, the first temperature range can be higher than the second temperature range, and the first transfer tube can have a larger inner diameter than the second transfer tube.

In various embodiments of the second aspect, the second temperature range can be higher than the first temperature range, and the second transfer tube can have a larger inner diameter than the first transfer tube.

In various embodiments of the second aspect, the operating pressure can be within a range of about $10^{-11}$ Torr to about $10^{-4}$ Torr.

In various embodiments of the second aspect, reducing the pump speed can include limiting the rotational speed of the vacuum pump.

In various embodiments of the second aspect, reducing the pump speed can include limiting the power draw of the pump.

In a third aspect, a mass spectrometer system can include an ion source, a vacuum chamber, a mass analyzer within the vacuum chamber, a first transfer tube between the ion source and the vacuum chamber, a transfer tube heater, and a vacuum pump. The ion source can be configured to produce ions from a sample. In various embodiments, the ion source can be at substantially atmospheric pressure. Alternatively, such as for sub ambient electrospray ionization, the ion source can be at sub ambient pressures, such as on the order of about $10^1$ to about $10^2$ Torr. The mass analyzer can be configured to determine mass-to-charge ratios for ions from the sample. The transfer tube can be configured to allow passage of the ions from the ion source to the vacuum chamber, the first transfer tube rated to operate at a temperature within a first range. The transfer tube heater can be configured to heat the transfer tube. The vacuum pump can be configured to maintain the vacuum chamber at a low pressure. The mass spectrometer system can further include a computer readable storage medium having program instructions for performing steps of: controlling the transfer tube heater to maintain the transfer tube at a first temperature within the first range and the vacuum pump to maintain the vacuum chamber at an operating pressure; receiving an instruction to set the transfer tube temperature to a second temperature, the second temperature within a second range and outside of the first range; notifying a user that the second temperature is outside the rated temperature range of the first transfer tube and to exchange the first transfer tube for a second transfer tube rated for the second temperature.

In various embodiments of the third aspect, the first temperature range can be between about 50° C. and about 550° C.

In various embodiments of the third aspect, the second temperature range can be between about 50° C. and about 550° C.

In various embodiments of the third aspect, the first temperature range and a second temperature range can be non-overlapping ranges.

In various embodiments of the third aspect, the first temperature range and a second temperature range can be partially overlapping ranges.

In various embodiments of the third aspect, the operating pressure can be within a range of about $10^{-11}$ Torr to about $10^{-4}$ Torr.

In various embodiments of the third aspect, reducing the pump speed includes limiting the rotational speed of the vacuum pump.

In various embodiments of the third aspect, reducing the pump speed includes limiting the power draw of the pump.

In various embodiments of the third aspect, the first temperature range is higher than the second temperature range, and the first transfer tube has a larger inner diameter than the second transfer tube.

In various embodiments of the third aspect, the second temperature range is higher than the first temperature range, and the second transfer tube has a larger inner diameter than the first transfer tube.

In a forth aspect, a transfer tube kit for a mass spectrometer system can include a first transfer tube having a first inner diameter, and a second transfer tube having a second inner diameter. The first transfer tube can be rated for operating within a first temperature range, and the second transfer tube can be rated for operating within a second temperature range.

In various embodiments of the forth aspect, the first temperature range and a second temperature range can be non-overlapping ranges.

In various embodiments of the forth aspect, the first temperature range and a second temperature range can be partially overlapping ranges.

In a fifth aspect, a mass spectrometer system can include an ion source, a vacuum chamber; a mass analyzer within the low pressure chamber, a first transfer tube between the ion source and the vacuum chamber, a transfer tube heater, and a vacuum pump. The ion source can be configured to produce ions from a sample. In various embodiments, the ion source can be at substantially atmospheric pressure. Alternatively, such as for sub ambient electrospray ionization, the ion source can be at sub ambient pressures, such as on the order of about $10^1$ to about $10^2$ Torr. The mass analyzer can be configured to determine mass-to-charge ratios for ions from the sample. The first transfer tube can be configured to allow passage of the ions from the ion source to the vacuum chamber. The transfer tube heater can be configured to heat the transfer tube to and maintain the transfer tube at an operating temperature. The vacuum pump can be configured to maintain the vacuum chamber at a low pressure. The mass spectrometer system can further include a computer readable storage medium having program instructions for performing steps of: controlling the transfer tube heater to maintain the first transfer tube at the operating temperature and the vacuum pump to maintain the vacuum chamber at an operating pressure; spinning down the vacuum pump in response to receiving a venting instruction; maintaining the temperature of the transfer tube above a first temperature threshold until the vacuum pump speed is below a threshold pump speed; and turning off the transfer tube heater after the vacuum pump speed is below the threshold pump speed.

In various embodiments of the fifth aspect, the operating temperature can be within a range of about 50° C. to about 550° C.

In various embodiments of the fifth aspect, the operating pressure can be within a range of about $10^{-11}$ Torr to about $10^{-4}$ Torr.

In various embodiments of the fifth aspect, spinning down the vacuum pump can include cutting power to the vacuum pump.

In various embodiments of the fifth aspect, the computer readable storage medium can further include program instructions for performing steps of: heating transfer tube prior to activating the vacuum pump; and activating the vacuum pump to reduce the pressure of the vacuum chamber to the operating pressure after the temperature of the transfer tube exceeds a second temperature threshold.

DRAWINGS

For a more complete understanding of the principles disclosed herein, and the advantages thereof, reference is now made to the following descriptions taken in conjunction with the accompanying drawings, in which.

Figure 1:
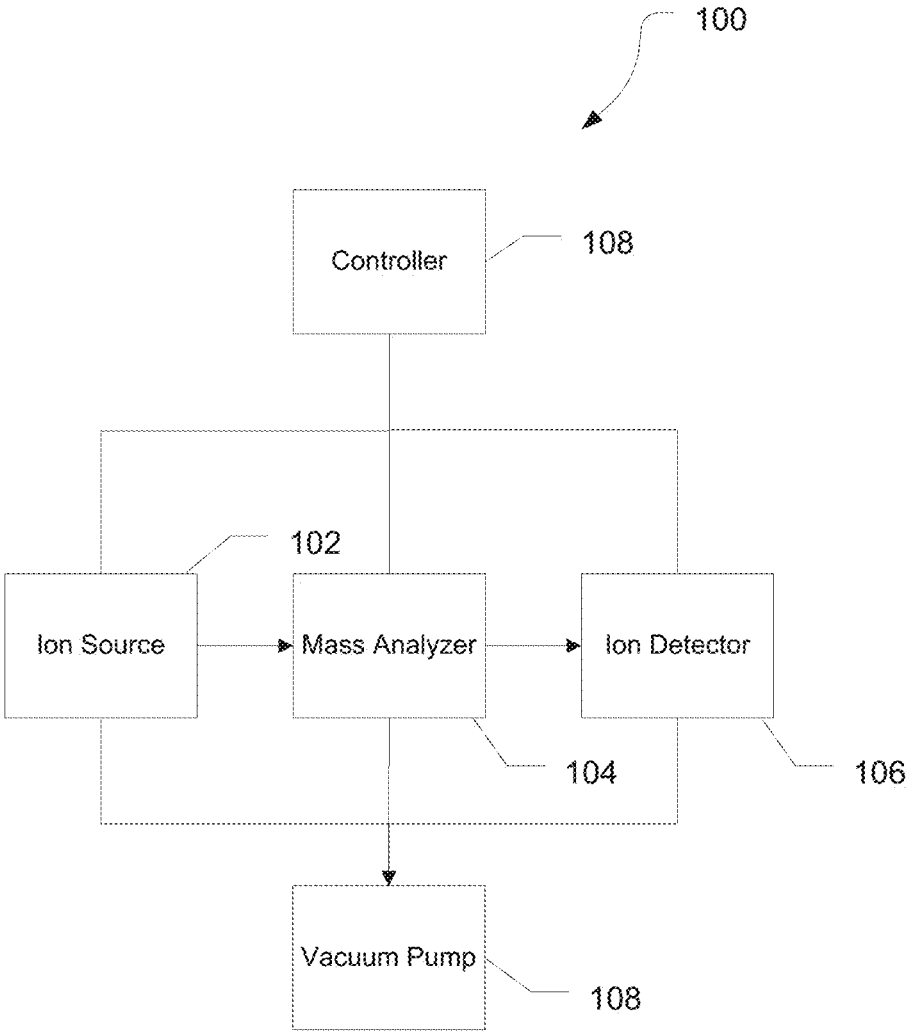
FIG. 1 is a block diagram of an exemplary mass spectrometry system, in accordance with various embodiments.

It is to be understood that the figures are not necessarily drawn to scale, nor are the objects in the figures necessarily drawn to scale in relationship to one another. The figures are depictions that are intended to bring clarity and understanding to various embodiments of apparatuses, systems, and methods disclosed herein. Wherever possible, the same reference numbers will be used throughout the drawings to refer to the same or like parts. Moreover, it should be appreciated that the drawings are not intended to limit the scope of the present teachings in any way.

DESCRIPTION OF VARIOUS EMBODIMENTS

Embodiments of systems and methods for ion separation are described herein.

The section headings used herein are for organizational purposes only and are not to be construed as limiting the described subject matter in any way.

In this detailed description of the various embodiments, for purposes of explanation, numerous specific details are set forth to provide a thorough understanding of the embodiments disclosed. One skilled in the art will appreciate, however, that these various embodiments may be practiced with or without these specific details. In other instances, structures and devices are shown in block diagram form. Furthermore, one skilled in the art can readily appreciate that the specific sequences in which methods are presented and performed are illustrative and it is contemplated that the sequences can be varied and still remain within the spirit and scope of the various embodiments disclosed herein.

All literature and similar materials cited in this application, including but not limited to, patents, patent applications, articles, books, treatises, and internet web pages are expressly incorporated by reference in their entirety for any purpose. Unless described otherwise, all technical and scientific terms used herein have a meaning as is commonly understood by one of ordinary skill in the art to which the various embodiments described herein belongs.

It will be appreciated that there is an implied "about" prior to the temperatures, concentrations, times, pressures, flow rates, cross-sectional areas, etc. discussed in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting. It is to be understood that both the foregoing general description and the following detailed description are exemplary and explanatory only and are not restrictive of the present teachings.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular.

A "system" sets forth a set of components, real or abstract, comprising a whole where each component interacts with or is related to at least one other component within the whole.

Mass Spectrometry Platforms

Various embodiments of mass spectrometry platform 100 can include components as displayed in the block diagram of FIG. 1. In various embodiments, elements of FIG. 1 can be incorporated into mass spectrometry platform 100. According to various embodiments, mass spectrometer 100 can include an ion source 102, a mass analyzer 104, an ion detector 106, and a controller 108.

In various embodiments, the ion source 102 generates a plurality of ions from a sample. The ion source can include, but is not limited to, a matrix assisted laser desorption/ionization (MALDI) source, electrospray ionization (ESI) source, heated electrospray ionization (HESI) source, nano-electrospray ionization (nESI) source, atmospheric pressure chemical ionization (APCI) source, atmospheric pressure photoionization source (APPI), inductively coupled plasma (ICP) source, electron ionization source, chemical ionization source, photoionization source, glow discharge ionization source, thermospray ionization source, and the like. In various embodiments, the ion source can be at substantially atmospheric pressure. Alternatively, such as for sub ambient electrospray ionization, the ion source can be at sub ambient pressures, such as on the order of about $10^1$ to about $10^2$ Torr.

In various embodiments, the mass analyzer 104 can separate ions based on a mass-to-charge ratio of the ions. For example, the mass analyzer 104 can include a quadrupole mass filter analyzer, a quadrupole ion trap analyzer, a time-of-flight (TOF) analyzer, an electrostatic trap mass analyzer (e.g., ORBITRAP mass analyzer), Fourier transform ion cyclotron resonance (FT-ICR) mass analyzer, magnetic sector, and the like. In various embodiments, the mass analyzer 104 can also be configured to fragment the ions using collision induced dissociation (CID), electron transfer dissociation (ETD), electron capture dissociation (ECD), photo induced dissociation (PID), surface induced dissociation (SID), and the like, and further separate the fragmented ions based on the mass-to-charge ratio.

In various embodiments, the ion detector 106 can detect ions. For example, the ion detector 106 can include an electron multiplier, a Faraday cup, and the like. Ions leaving the mass analyzer can be detected by the ion detector. In various embodiments, the ion detector can be quantitative, such that an accurate count of the ions can be determined.

In various embodiments, the controller 108 can communicate with the ion source 102, the mass analyzer 104, and the ion detector 106. For example, the controller 108 can configure the ion source or enable/disable the ion source. Additionally, the controller 108 can configure the mass analyzer 104 to select a particular mass range to detect. Further, the controller 108 can adjust the sensitivity of the ion detector 106, such as by adjusting the gain. Additionally, the controller 108 can adjust the polarity of the ion detector 106 based on the polarity of the ions being detected. For example, the ion detector 106 can be configured to detect positive ions or be configured to detect negative ions.

Figure 2:
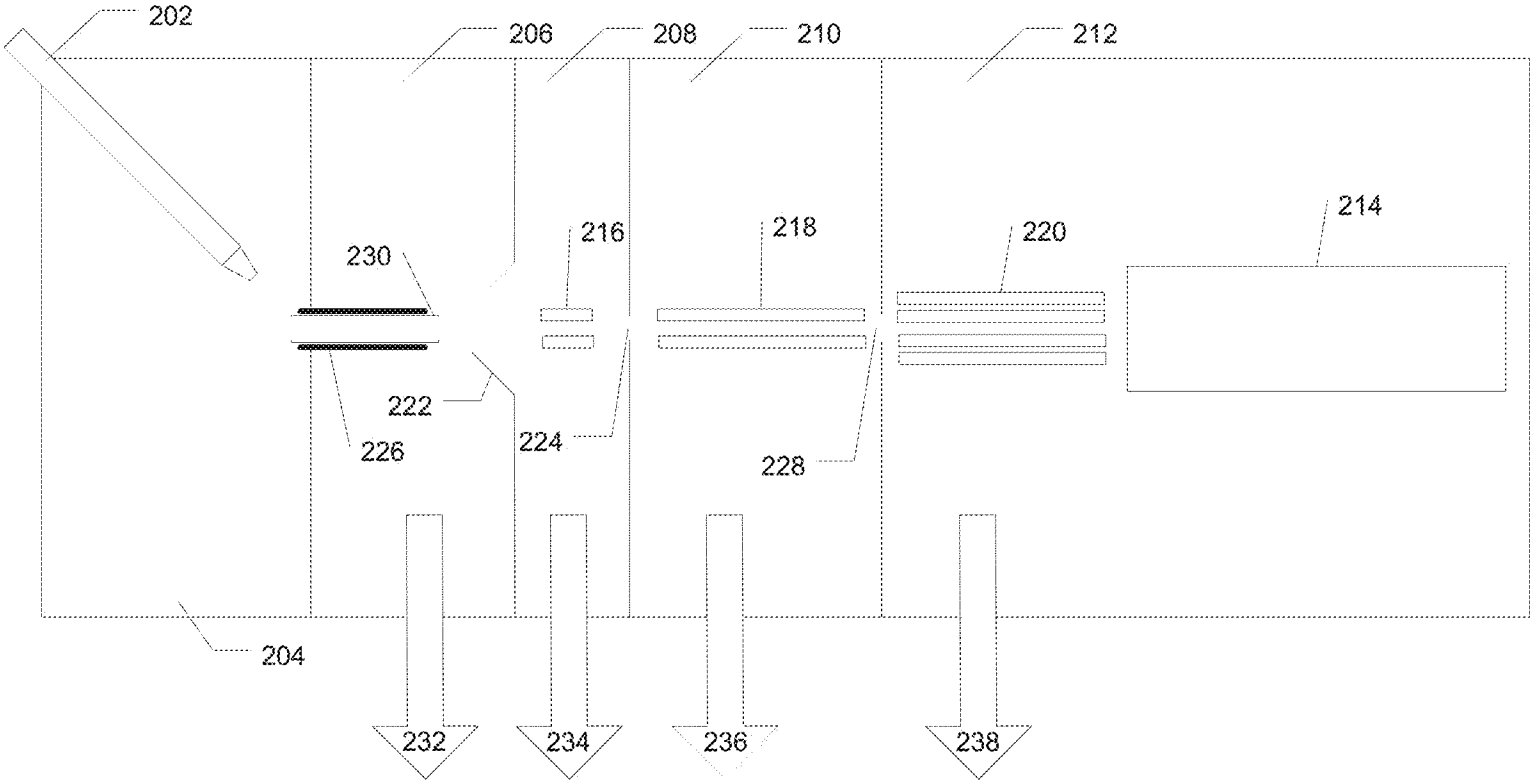
FIG. 2 is a block diagram of an exemplary mass spectrometry system, in accordance with various embodiments.

FIG. 2 depicts the components of a mass spectrometer 200, in accordance with various embodiments of the present invention. It will be understood that certain features and configurations of mass spectrometer 200 are presented by way of illustrative examples, and should not be construed as limiting to implementation in a specific environment. An ion source, which may take the form of an electrospray ion source 202, generates ions from an analyte material, for example the eluate from a liquid chromatograph (not depicted). The ions are transported from ion source chamber 204, which for an electrospray source will typically be held at or near atmospheric pressure, through several intermediate chambers 206, 208, and 210 of successively lower pressure, to a vacuum chamber 212 in which mass analyzer 214 resides. Efficient transport of ions from ion source 202 to mass analyzer 214 is facilitated by a number of ion optic components, including quadrupole RF ion guides 216 and 218, an optional multipole RF ion guide 220, skimmer 222, and electrostatic lenses 224 and 228. Ions may be transported between ion source chamber 204 and first intermediate chamber 206 through an ion transfer tube 230 that is heated to evaporate residual solvent and break up solvent-analyte clusters. The ion transfer tube could also be an orifice. The ion transfer tube 230 can be heated and maintained at an operating temperature by an ion transfer tube heater 226. Intermediate chambers 206, 208, and 210 and vacuum chamber 212 are evacuated by a suitable arrangement of pumps to maintain the pressures therein at the desired values. In one example, intermediate chamber 206 communicates with a port 232 of a mechanical pump, and intermediate chambers 208 and 210 and vacuum chamber 212 communicate with corresponding ports 234, 236, and 238 of a multistage, multiport turbomolecular pump. In various embodiments, port 232 could communicate with a turbomolecular pump rather than a mechanical pump.

The operation of the various components of mass spectrometer 200 is directed by a control and data system (not depicted), which will typically consist of a combination of general-purpose and specialized processors, application-specific circuitry, and software and firmware instructions. The control and data system also provides data acquisition and post-acquisition data processing services.

While mass spectrometer 200 is depicted as being configured for an electrospray ion source, it should be noted that the mass analyzer 214 may be employed in connection with any number of pulsed or continuous ion sources (or combinations thereof), including without limitation a heated electrospray ionization (HESI) source, a nanoelectrospray ionization (nESI) source, a matrix assisted laser desorption/ionization (MALDI) source, an atmospheric pressure chemical ionization (APCI) source, an atmospheric pressure photo-ionization (APPI) source, an electron ionization (EI) source, or a chemical ionization (CI) ion source.

Ion Transfer and Vacuum Pump Load

In various embodiments, the gas flow through the ion transfer tube dictates the requirements for the pumping system of the mass spectrometer. In order to maintain the high vacuum needed to perform the mass analysis, the gas entering the vacuum chamber through the ion transfer tube needs to be effectively removed from the vacuum chamber. However, sensitivity of the mass spectrometer is proportional to the gas flow through the ion transfer tube, as increasing the gas flow can increase the number of ions available for analysis.

Figure 3:
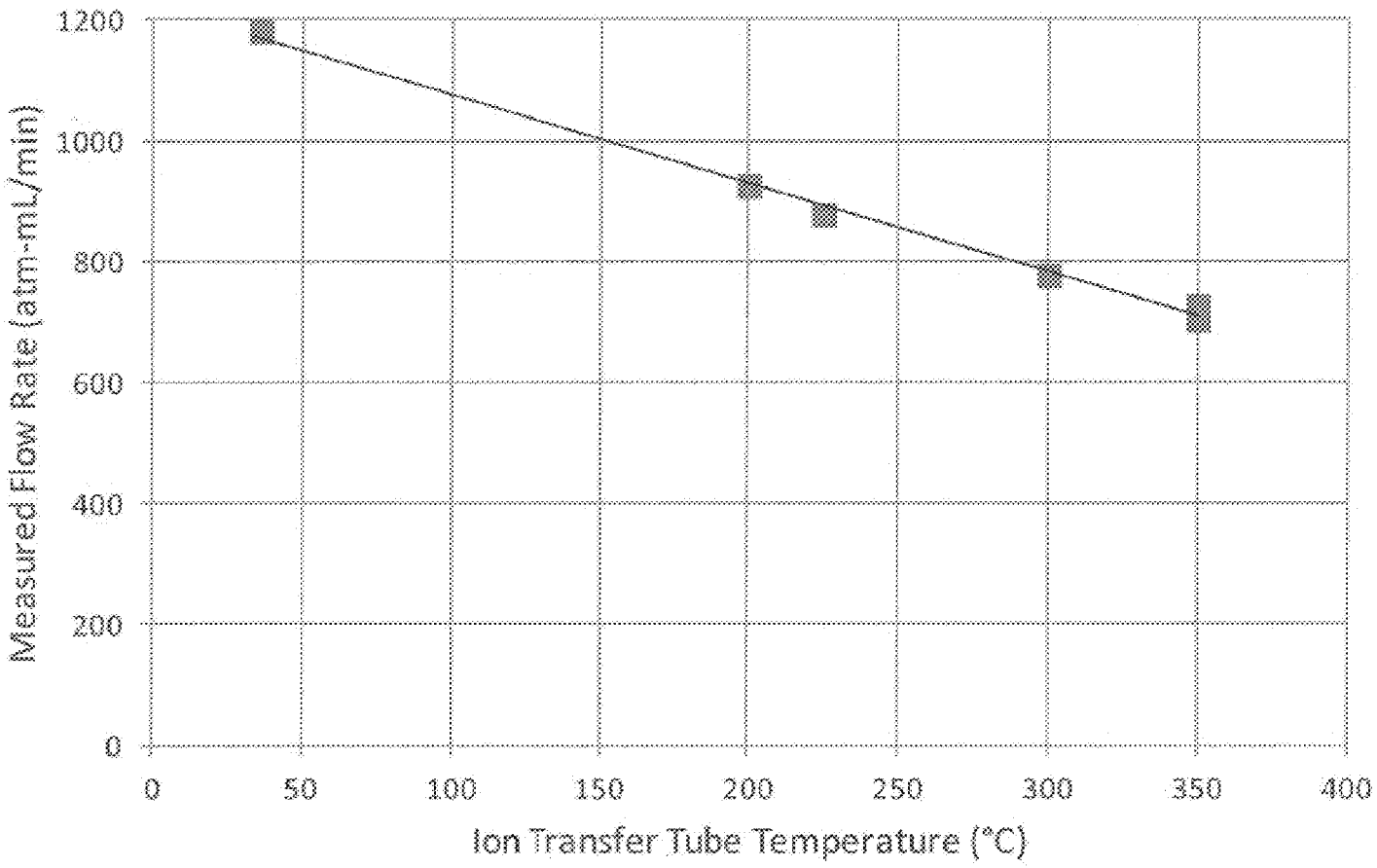
FIG. 3 is a plot of the relationship between the ion transfer tube temperature and the flow rate, in accordance with various embodiments.

In various embodiments, the temperature of the ion transfer tube can affect the flow rate into the vacuum system. FIG. 3 is a plot of ion transfer tube temperature against the measure flow rate for an exemplary system. Typical operating temperatures for an ion transfer tube are around 350° C., yet vacuum systems are typically sized according to the gas flow through the ion transfer tube at room temperature to enable effective pumping down of the system from a cold start. As is shown by FIG. 3, the gas flow through the ion transfer tube at room temperature can be about 1.7 times the gas flow through the ion transfer tube at an operating temperature of 350° C.

Figure 4:
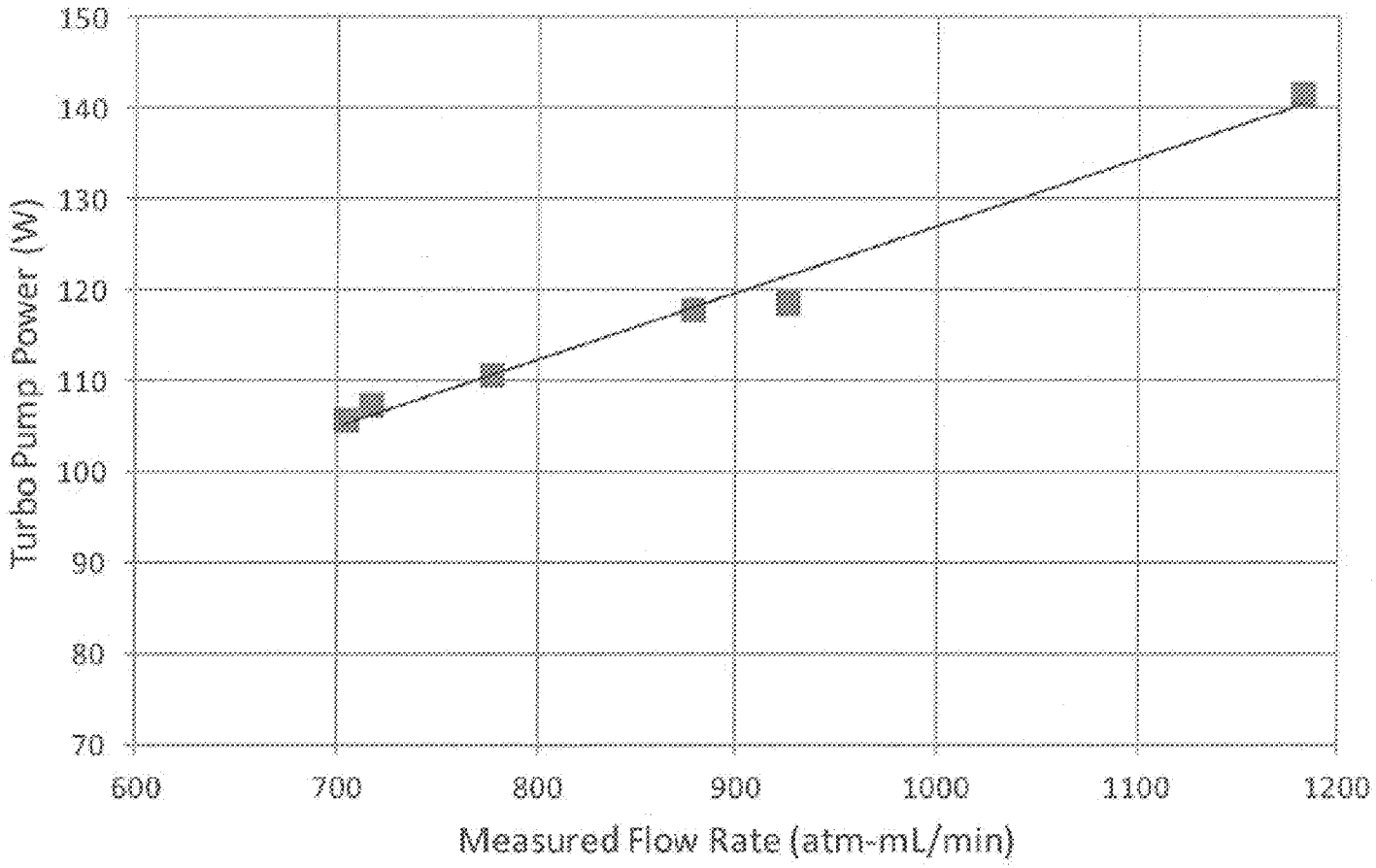
FIG. 4 is a plot of the relationship between the flow rate and the power draw of the turbomolecular pump, in accordance with various embodiments.

Additionally, as the gas load increases, the power consumed by the turbomolecular pump increases. FIG. 4 is a plot of measured flow rate against the power consumed by an exemplary turbomolecular pump. Some of the power ends up heating the pump. In various embodiments, at a power draw of about 115 W, the resulting high temperatures can reduce the strength of the aluminum rotors within the turbomolecular pump. As a result, the rotors can be deformed by the high centrifugal forces within the pump.

Figure 5:
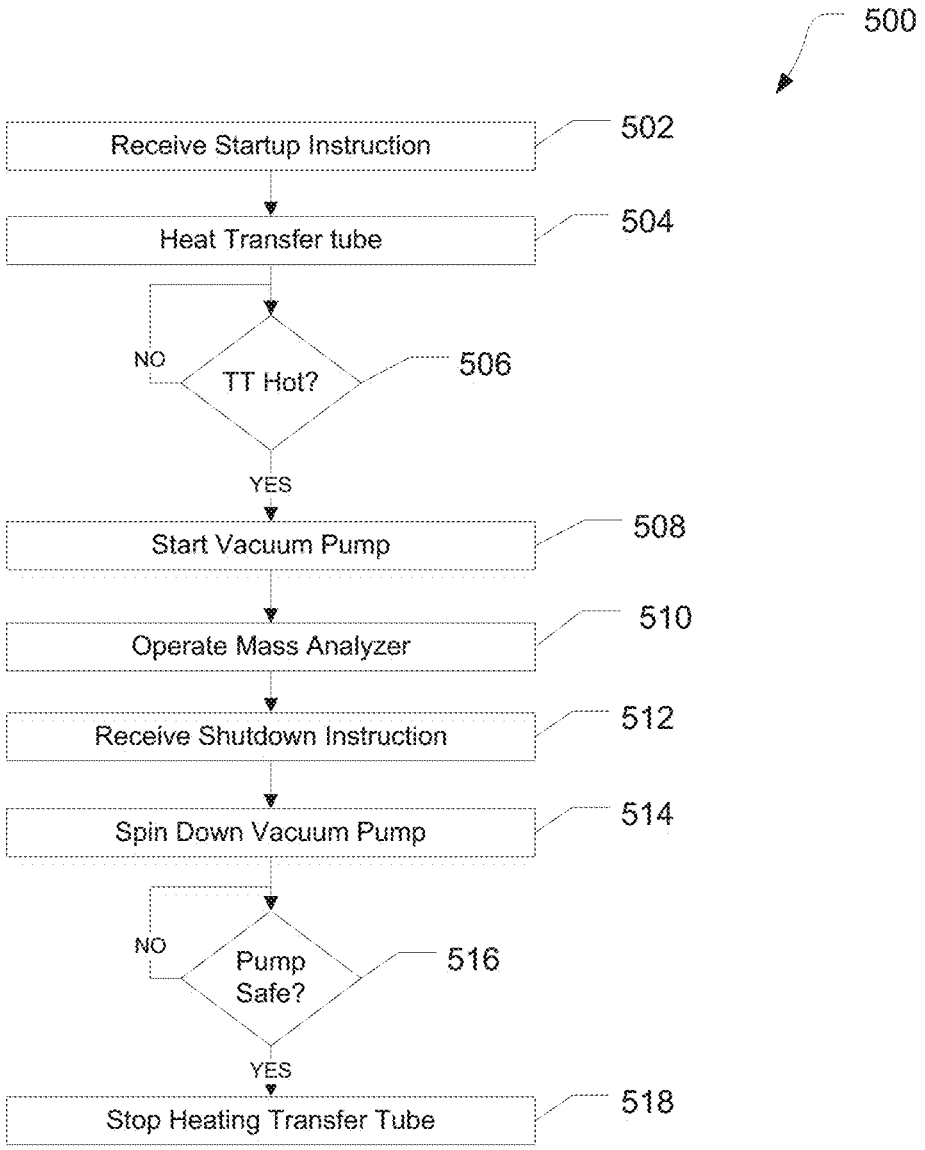
FIG. 5 is a flow diagram illustrating a method of controlling a vacuum pump and a transfer tube heater while starting up and shutting down a mass spectrometry instrument, in accordance with various embodiments.

FIG. 5 is a flow diagram illustrating an exemplary method of controlling an ion transfer tube heater and a vacuum pump to reduce the peak gas flow. At 502, the system can receive a startup instruction. In various embodiments, this can occur at the direction of a user or automatically after power on when control systems have completed an initialization process and system checks.

At 504, the ion transfer tube heater can begin to heat the ion transfer tube. Generally, the mass spectrometry system can be operated with the ion transfer tube at an operating temperature, such as about 50° C. to at about 550° C. At 506, the system can monitor the temperature of the ion transfer tube to determine if the ion transfer tube temperature has exceeded a threshold. In various embodiments, the threshold may be below the operating temperature of the ion transfer tube but above a point where the gas flow through the ion transfer tube no longer exceed a rated flow for the vacuum pump. When the temperature has not yet reached or exceeded the threshold, the system can continue to monitor the temperature of the ion transfer tube at 506.

When the temperature reaches or exceeds the threshold, the system can start the vacuum pump at 508. With the vacuum pump working, and the pressure in the mass analyzer within an operating range, such as between about $10^{-11}$ Torr and about $10^{-4}$ Torr depending on the configuration of the vacuum system, the mass analyzer can be used to determine mass-to-charge ratios of gas-phase ions, as indicated at 510. In various embodiments, the gas-phase ions can be introduced by vaporizing and ionizing a sample, such as a sample resolved on a HPLC.

At 512, the system can receive a shutdown instruction. In various embodiments, the system can be shut down for routine maintenance, for service, to conserve resources such as over a holiday period, for relocation, or any other reason it may be desirable to have the system in a powered down state. Upon receiving the shutdown instruction, the system can spin down the vacuum pump, as indicated at 514. The system can monitor the vacuum pump at 516 to determine if the vacuum pump has spun down to a safe level. When the vacuum pump is not yet at a safe level, the system can continue to monitor the vacuum pump at 516. When the vacuum pump has reached a safe level, the ion transfer tube heater can be turned off at 518 and the ion transfer tube can be allowed to cool.

In various embodiments, by ensuring the ion transfer tube is heated above a threshold temperature before the vacuum pump is started and stays above the threshold temperature until the vacuum pump has spun down to a safe level, the system can ensure the vacuum pump does not receive an excessive load sufficient to weaken the vacuum pump or shorten its operational lifetime. Additionally, by not needing to size the pump to handle the gas flow through the ion transfer tube at room temperature, a small vacuum pump can be used, thereby reducing the overall cost of the mass spectrometer system.

Figure 6:
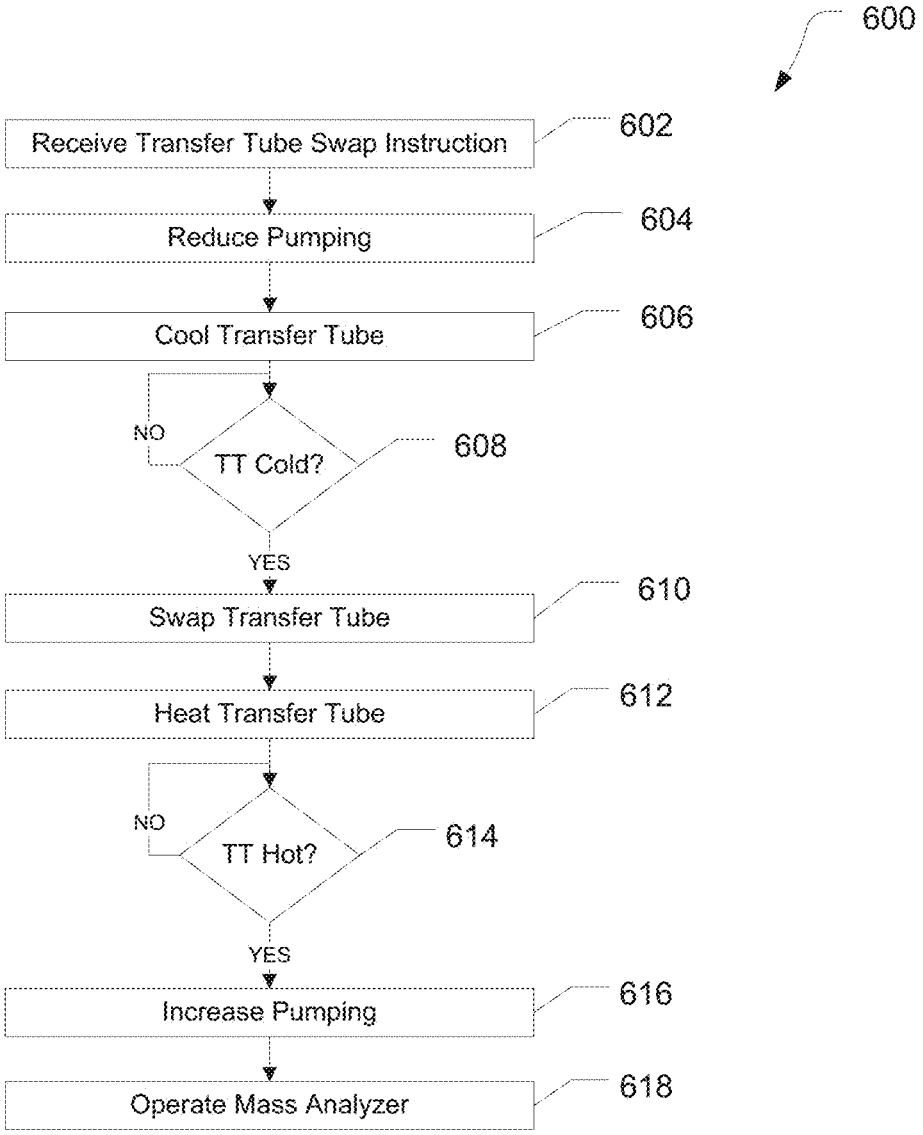
FIG. 6 is a flow diagram illustrating a method of controlling a vacuum pump and a transfer tube heater while swapping ion transfer tubes, in accordance with various embodiments.

FIG. 6 is a flow diagram illustrating an exemplary method of changing the ion transfer tube and while operating the vacuum pump at a reduced speed to account for the increased gas flow. In various embodiments, the ion transfer tube may need to be changed for cleaning or to use an ion transfer tube having a different inner diameter. At 602, the system can receive an ion transfer tube swap instruction. In various embodiments, this can occur at the direction of a user by activating a contact or selecting a user interface element within control software.

At 604, the system can reduce the pumping of the vacuum pump. For example, the vacuum pump can be configured to limit a rotational speed of the vacuum pump. Alternatively, the system can be configured to limit the power draw of the vacuum pump.

At 660, with the vacuum pump operating at a reduced pump speed, the system can cool the ion transfer tube, such as by shutting off the ion transfer tube heater. The system can monitor the ion transfer tube temperature at 608 to determine if the ion transfer tube has cooled to a safe level. When the ion transfer tube is not yet at a safe level, the system can continue to monitor the ion transfer tube temperature at 608. When the ion transfer tube temperature has reached a safe level, the ion transfer tube can be removed and a different ion transfer tube can be put in its place, as indicated at 610. In various embodiments, the system can provide an indication to the user that the ion transfer tube is at a temperature that is safe to handle. For example, the system can toggle a light to indicate the ion transfer tube is at a safe temperature or the system can display a message on a user interface to indicate the ion transfer tube can be swapped.

At 612, after the ion transfer tube has been swapped, the new ion transfer tube can be heated. At 614, the system can monitor the temperature of the ion transfer tube to determine if the ion transfer tube temperature has exceeded a threshold needed to return the vacuum pump to full operation. When the temperature has not yet reached or exceeded the threshold, the system can continue to monitor the temperature of the ion transfer tube at 614.

When the temperature reaches or exceeds the threshold, the system can return the vacuum pump to full operation, as indicated at 616. With the vacuum pump working, and the pressure within an operating range, the mass analyzer can be used to determine mass-to-charge ratios of gas-phase ions, as indicated at 618.

In various embodiments, limiting the pump speed while the ion transfer tube is swapped can reduce negative impacts to the vacuum pump due to the increased gas flow. Negative impacts can include operation at elevated temperatures which can cause deformation of the turbomolecular pump rotor because of the high centrifugal forces. Further, by maintaining at least some level of vacuum pump operation, the pressure within the vacuum chamber can be maintained below atmospheric pressure. By maintaining a partial vacuum within the vacuum chamber, rather than shutting down the vacuum pump and venting the chamber to atmosphere, the time needed to return the vacuum chamber to an operating pressure can be reduced, thereby reducing the downtime for the mass spectrometer for quick maintenance tasks such as swapping the ion transfer tube.

Figure 7:
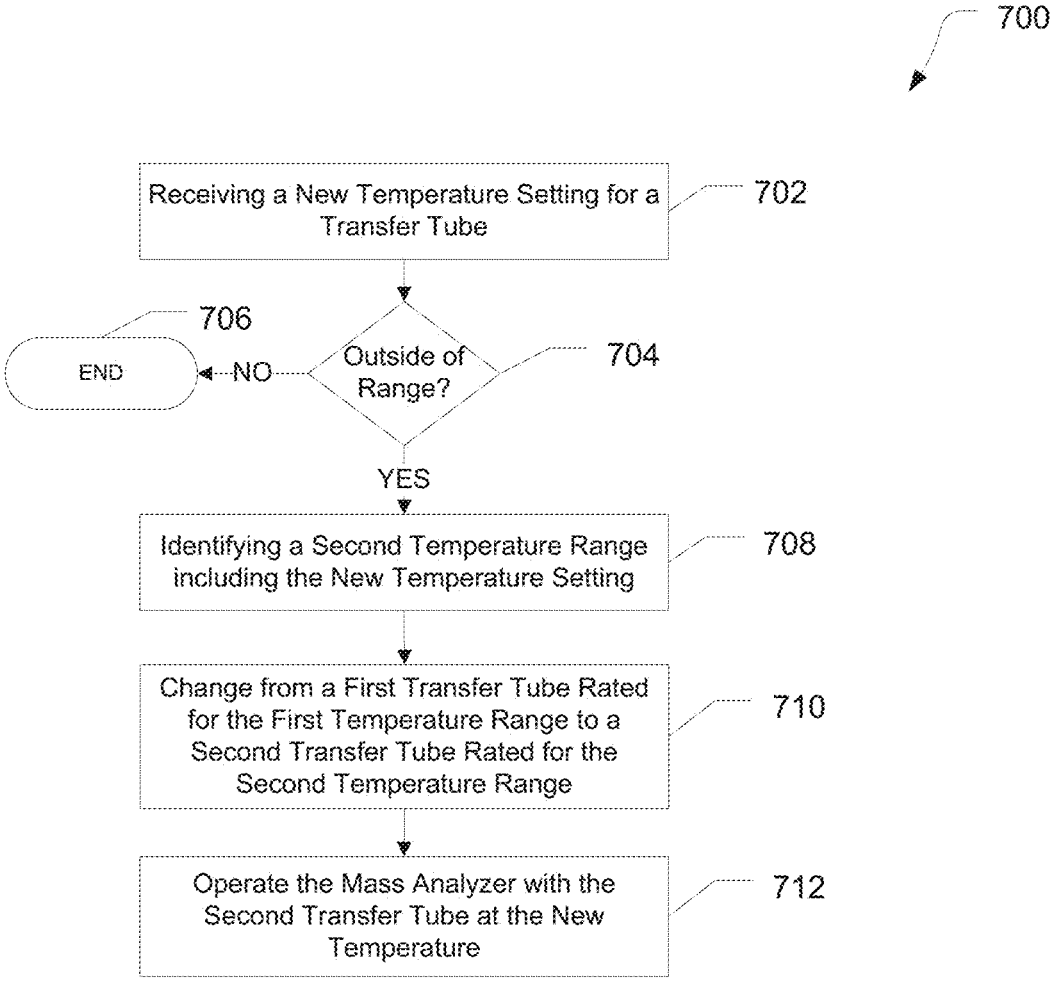
FIGS. 7 and 8 are flow diagrams illustrating a method of matching an ion transfer tube to a temperature range, in accordance with various embodiments.

FIG. 7 is a flow diagram illustrating an exemplary method of matching an ion transfer tube to an operating temperature range to maintain the gas flow through the ion transfer tube at a suitable level for the operation of the vacuum pump. At 702, the system can receive a new temperature setting for the ion transfer tube.

At 704, the system can determine if the new temperature setting is outside of an operating temperature range for the ion transfer tube. In various embodiments, ion transfer tubes can be rated for operation in a temperature range that ensures the gas flow through the ion transfer tube within that temperature range is suitable for the operation of the vacuum pump. For example, an ion transfer tube rated for a low operating temperature, such as in a range of between about 150° C. to about 350° C., may have a smaller inner diameter than an ion transfer tube rated for a higher operating temperature, such as in a range of between about 300° C. to about 550° C. In various embodiments, the temperature range can be non-overlapping or partially overlapping. When the new temperature setting is within the temperature range suitable for the current ion transfer tube, the method can end at 706.

Alternatively, when the new temperature setting is outside of the temperature range suitable for the current ion transfer tube, the system can identify a second temperature range that includes the new temperature setting, as indicated at 708. Additionally, the system can notify the user that the ion transfer tube needs to be replaced with an alternate ion transfer tube rated for the temperature setting. In various embodiments, this can occur by providing a message to the user through a user interface. Additionally, the system may not change the temperature of the ion transport tube until the ion transfer tube is replaced with a suitable ion transfer tube.

At 710, the ion transfer tube can be removed and a different ion transfer tube can be put in place. In various embodiments, the system can perform the method illustrated in FIG. 6 for swapping the ion transfer tube. With the new ion transfer tube rated for the new temperature range in place, and the ion transfer tube at the new temperature and the pressure in the vacuum chamber within operating range, the mass analyzer can be used to determine mass-to-charge ratios of gas-phase ions, as indicated at 712.

In various embodiments, it can be desirable to maximize the flow of ions into and through the mass spectrometer system. Large diameter ion transfer tubes can accommodate a greater gas flow at a given temperature and therefor allow more ions into the system. Alternatively, the vacuum pump may be rated for a maximum gas flow. To maximize gas flow at various temperatures, it can be advantageous to have ion transfer tubes of different inner diameters rated for use at different temperature ranges. In this way, as temperature is increased and the gas flow decreases (see FIG. 3), a different ion transfer tube with a large inner diameter can be used to maintain the gas flowing within a desirable range. This can prevent overload of the vacuum pump while ensure a sufficient flow of ions into the system.

Figure 8:
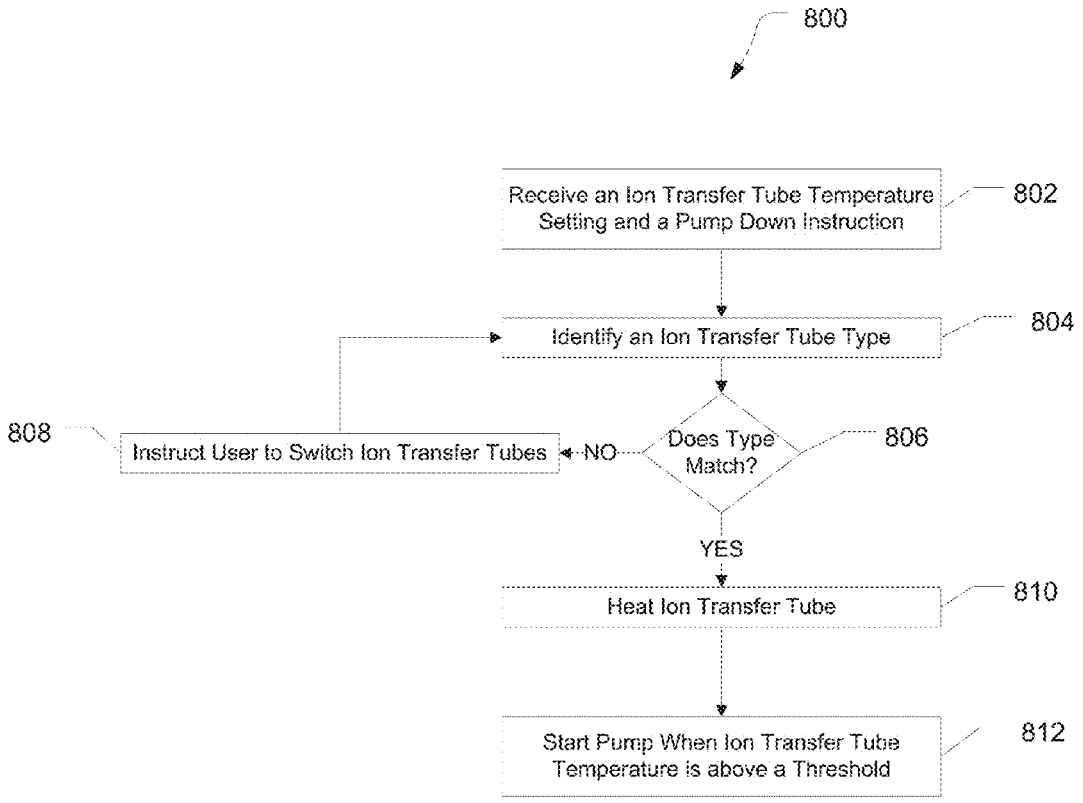

FIG. 8 is a flow diagram illustrating an exemplary method of matching an ion transfer tube to an operating temperature range to maintain the gas flow through the ion transfer tube at a suitable level for the operation of the vacuum pump. At 802, the system can receive a temperature setting for the ion transfer tube and a pump down instruction.

At 804, the system can identify the ion transfer tube in place. In various embodiments, the system can determine an inner diameter of the ion transfer tube, such as by an optical measurement, identifying markings on the ion transfer tube, or measuring a flow rate through the ion transfer tube at a temperature. At 806, the system can determine if the temperature setting is outside of an operating temperature range for the ion transfer tube. In various embodiments, ion transfer tubes can be rated for operation in a temperature range that ensures the gas flow through the ion transfer tube within that temperature range is suitable for the operation of the vacuum pump.

When the temperature setting is not within the temperature range suitable for the current ion transfer tube, the system can instruct the user to switch the ion transfer tube, as indicated at 808. When the ion transfer tube has been replaced, the system can verify the new ion transfer tube is suitable for the temperature setting, as indicated at 804.

Once the ion transfer tube is known to correspond to the temperature setting, the system can heat the ion transfer tube to the operating temperature, as indicated at 810. When the ion transfer tube is above a threshold temperature for safe operation of the vacuum pump, the vacuum pump can be started or allowed to return to full speed, as indicated at 812.

Figure 9:
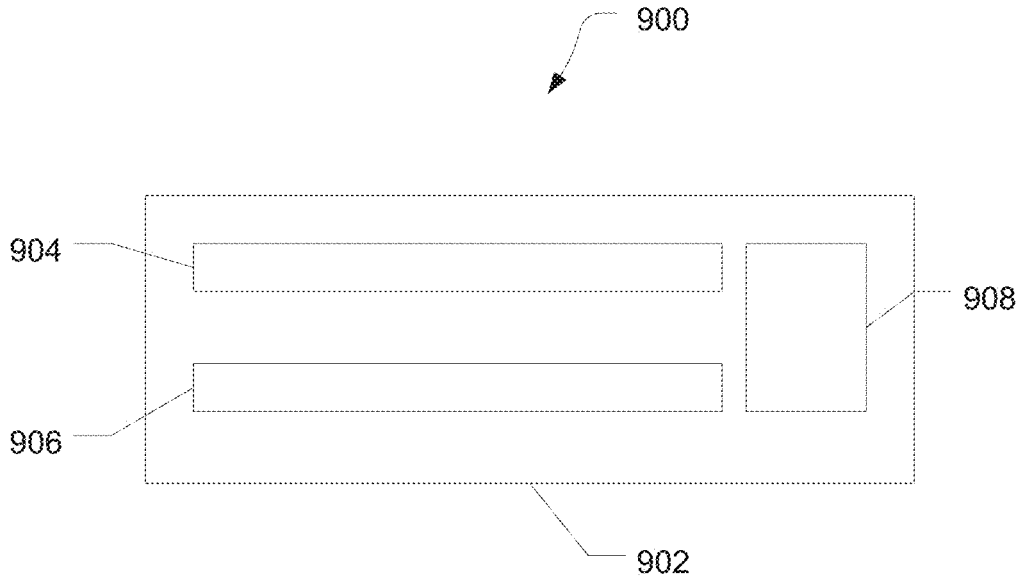
FIG. 9 is a block diagram illustrating an ion transfer tube kit, in accordance with various embodiments.

FIG. 9 is a block diagram illustrating a kit 900 containing ion transfer tubes rated for different temperature ranges. The kit 900 can include a case 902, an ion transfer tube 904, and an ion transfer tube 906. The ion transfer tube 904 can have a smaller inner diameter and be rated for a lower temperature range, such as, for example, between about 100° C. and 350° C. The ion transfer tube 906 can have a larger inner diameter and be rated for a higher temperature range, such as, for example, between about 300° C. and 550° C. In various embodiments, the ion transfer tube kit 900 can include more than two ion transfer tubes, such as ion transfer tubes with additional temperature ranges and/or multiple ion transfer tubes for each temperature range. In various embodiments, the temperature range can be non-overlapping or partially overlapping. Additionally, the kit 900 can include a label 908 or other printed material identifying the ion transfer tubes 904 and 906 and the rated temperature ranges for each. In various embodiments, the ion transfer tubes 904 and 906 can be labeled with an identifier and/or the temperature range, such as by printing or etching the label on the outer surface of ion transfer tubes 904 and 906.

While the present teachings are described in conjunction with various embodiments, it is not intended that the present teachings be limited to such embodiments. On the contrary, the present teachings encompass various alternatives, modifications, and equivalents, as will be appreciated by those of skill in the art.

Further, in describing various embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the various embodiments.

What is claimed is:

1. A mass spectrometer system comprising:

an ion source, the ion source configured to produce ions from a sample;

a vacuum chamber;

a mass analyzer within the vacuum chamber, the mass analyzer configured to determine mass-to-charge ratios for ions from the sample;

a first transfer tube between the ion source and the vacuum chamber, the first transfer tube configured to allow passage of the ions from the ion source to the vacuum chamber, the first transfer tube rated to operate at a temperature within a first temperature range;

a transfer tube heater configured to heat the transfer tube;

a vacuum pump configured to maintain the vacuum chamber at a low pressure;

a computer readable storage medium having program instructions for performing steps of:

controlling the transfer tube heater to maintain the transfer tube at a first temperature within the first temperature range and the vacuum pump to maintain the vacuum chamber at an operating pressure;

receiving an instruction to set the transfer tube temperature to a second temperature, the second temperature within a second temperature range and outside of the first range;

reducing the pump speed of the vacuum pump in response to receiving a transfer tube swap instruction;

lowering the temperature of the transfer tube to below an exchange temperature;

operating the vacuum pump at the reduced pump speed while the first transfer tube is replaced with a second transfer tube to maintain the vacuum chamber at a pressure between atmospheric pressure and the operating pressure, the second transfer tube rated for operating in the second temperature range;

heating a second transfer tube to the second temperature; and increasing the pump speed of the vacuum pump after the temperature of the second transfer tube exceeds a threshold to return the mass analyzer to the operating pressure.

2. The mass spectrometer system of claim 1 wherein the first temperature range between about 50° C. and about 550° C.

3. The mass spectrometer system of claim 1 wherein the second temperature range between about 50° C. and about 550° C.

4. The mass spectrometer system of claim 1 wherein the first temperature range and a second temperature range are non-overlapping ranges.

5. The mass spectrometer system of claim 1 wherein the first temperature range is higher than the second temperature range, and the first transfer tube has a larger inner diameter than that of the second transfer tube.

6. The mass spectrometer system of claim 1 wherein the second temperature range is higher than the first temperature range, and the second transfer tube has a larger inner diameter than that of the first transfer tube.

7. The mass spectrometer system of claim 1 wherein the operating pressure is within a range of about $10^{-11}$ Torr to about $10^{-4}$ Torr.

8. The mass spectrometer system of claim 1 wherein reducing the pump speed includes limiting the rotational speed of the vacuum pump.

9. The mass spectrometer system of claim 1 wherein reducing the pump speed includes limiting the power draw of the pump.

10. A mass spectrometer system comprising:

an ion source, the ion source configured to produce ions from a sample;

a vacuum chamber;

a mass analyzer within the vacuum chamber, the mass analyzer configured to determine mass-to-charge ratios for ions from the sample;

a first transfer tube between the ion source and the vacuum chamber, the transfer tube configured to allow passage of the ions from the ion source to the vacuum chamber, the first transfer tube rated to operate at a temperature within a first range;

a transfer tube heater configured to heat the transfer tube;

a vacuum pump configured to maintain the vacuum chamber at a low pressure; and a computer readable storage medium having program instructions for performing steps of:

controlling the transfer tube heater to maintain the transfer tube at a first temperature within the first range and the vacuum pump to maintain the vacuum chamber at an operating pressure;

receiving an instruction to set the transfer tube temperature to a second temperature, the second temperature within a second range and outside of the first range; and notifying a user that the second temperature is outside the rated temperature range of the first transfer tube and to exchange the first transfer tube for a second transfer tube rated for the second temperature, wherein the first temperature range is higher than the second temperature range, and the first transfer tube has a larger inner diameter than that of the second transfer tube.

11. The mass spectrometer system of claim 10 wherein the first temperature range between about 50° C. and about 550° C.

12. The mass spectrometer system of claim 10 wherein the second temperature range between about 50° C. and about 550° C.

13. The mass spectrometer system of claim 10 wherein the first temperature range and a second temperature range are non-overlapping ranges.

14. The mass spectrometer system of claim 10 wherein the first temperature range and a second temperature range are partially overlapping ranges.

15. The mass spectrometer system of claim 10 wherein the operating pressure is within a range of about $10^{-11}$ Torr to about $10^{-4}$ Torr.

16. The mass spectrometer system of claim 10 wherein reducing the pump speed includes limiting the rotational speed of the vacuum pump.

17. The mass spectrometer system of claim 10 wherein reducing the pump speed includes limiting the power draw of the pump.

18. A mass spectrometer system comprising:

an ion source, the ion source configured to produce ions from a sample;

a vacuum chamber;

a mass analyzer within the vacuum chamber, the mass analyzer configured to determine mass-to-charge ratios for ions from the sample;

a first transfer tube between the ion source and the vacuum chamber, the transfer tube configured to allow passage of the ions from the ion source to the vacuum chamber, the first transfer tube rated to operate at a temperature within a first range;

a transfer tube heater configured to heat the transfer tube;

a vacuum pump configured to maintain the vacuum chamber at a low pressure; and a computer readable storage medium having program instructions for performing steps of:

controlling the transfer tube heater to maintain the transfer tube at a first temperature within the first range and the vacuum pump to maintain the vacuum chamber at an operating pressure;

receiving an instruction to set the transfer tube temperature to a second temperature, the second temperature within a second range and outside of the first range; and notifying a user that the second temperature is outside the rated temperature range of the first transfer tube and to exchange the first transfer tube for a second transfer tube rated for the second temperature, wherein the second temperature range is higher than the first temperature range, and the second transfer tube has a larger inner diameter than that of the first transfer tube.

* * * * *